US005480084A

United States Patent [19]

Daniels

[11] Patent Number: 5,480,084

[45] Date of Patent: Jan. 2, 1996

[54] DISPENSING RACK

[75] Inventor: Mark E. Daniels, Redondo Beach, Calif.

[73] Assignee: The Avantage Group, Inc., Redondo Beach, Calif.

[21] Appl. No.: 156,017

[22] Filed: Nov. 23, 1993

[51] Int. Cl.[6] ..... B26F 3/02

[52] U.S. Cl. ..... 225/106; 225/42; 225/46; 242/595

[58] Field of Search ..... 225/106, 39, 42, 225/46, 52; 211/16, 48; 221/26, 63; 242/566, 595, 595.1

[56] References Cited

U.S. PATENT DOCUMENTS

| | | | |
|---|---|---|---|
| 3,098,594 | 7/1963 | Williamson | 225/106 X |
| 4,179,055 | 12/1979 | Milner | 225/106 X |
| 4,930,385 | 6/1990 | Wilfong, Jr. et al. | 225/106 |
| 5,118,022 | 6/1992 | Farahnik | 225/106 |
| 5,135,146 | 8/1992 | Simhaee | 225/106 X |
| 5,170,957 | 12/1992 | Carpenter | 221/63 X |
| 5,207,368 | 5/1993 | Wilfong, Jr. et al. | 221/26 X |
| 5,209,371 | 5/1993 | Daniels | 225/1 X |

FOREIGN PATENT DOCUMENTS

| | | | |
|---|---|---|---|
| 881599 | 4/1943 | France | 225/106 |
| 380862 | 9/1932 | United Kingdom | 225/106 |

*Primary Examiner*—Rinaldi I. Rada
*Assistant Examiner*—Clark F. Dexter
*Attorney, Agent, or Firm*—Beehler & Pavitt

[57] ABSTRACT

A rack for dispensing plastic bags from a roll of bags joined end-to-end and separated by a line of perforations and either an opening or a rupturable central area between the bags along the perforation line, comprising a rectangular cradle to hold the roll for removal of bags by unrolling them over a horizontal side element and past a pair of snagging elements which intercept the rupturable central area to restrain each ensuing bag as the preceding bag is pulled away from the roll so as to enable the preceding bag to be separated from the ensuing bag along the perforated and open or rupturable central area line. Provision is made to enable the cradle to be mounted either on or under a store counter, or against a wall.

16 Claims, 4 Drawing Sheets

DISPENSING RACK

The present invention relates to an improvement over the apparatus described and claimed in U.S. Pat. No. 5,209,371 issued May 11, 1993, for use in practicing the method also described and claimed.

BACKGROUND OF THE INVENTION

While the apparatus disclosed and claimed in the above mentioned patent is indeed effective in enabling the method described and claimed in that patent to be effectively practiced, the racks illustrated and described in the patent have been found to occupy a greater amount of space in or around a merchandising counter than in some cases may be available. Moreover, the racks shown do not lend themselves readily to mounting the roll support on a vertical wall or under a counter top or shelf. In addition, it has been found that where a single centrally disposed snagging element is employed, if bags are pulled past it in a somewhat angular direction, the snagging element may be bypassed so that the severance of the bag being pulled from the ensuing bag may not be properly effected.

Further, in order to enable the method of the patent to be practiced in the greatest and most diverse number of retail environments, it is desirable to produce a merchandise roll dispenser of the smallest possible size and lowest fabrication cost, and one which may be installed on, adjacent to or under the counter or shelf at a convenient location for the clerk, and require a minimum amount of space. In some situations, it may be desirable to mount the rack on a vertical wall, on top of the counter or below the counter or shelf. Also, some first time users of the racks have been found reluctant to have their counters or cabinets drilled for mounting the racks.

SUMMARY OF THE INVENTION

The present invention constitutes improvements over the racks made in accordance with, and for practicing the methods of, the patent and accomplishes the objectives hereinabove described by providing a rack frame structure which may be either unitary, or may be readily interfitted into a relatively light weight unit having plate means with certain adhesive outer surfaces which enable the rack to be fixedly secured either to, or under a counter top, under a shelf or to a vertical wall surface, in some instances without the necessity of drilling holes for screws, bolts or other means to secure the rack to such surface.

The rack may thus be disposed in the most convenient area, both from the standpoint of accessibility and flexibility as well as unobtrusiveness, and may easily be mounted at any of a number of locations. In addition, the rack of the present invention is designed to enhance the use of this device and occupy a minimum amount of space, or even unused space, as compared with the rack of the prior patent.

In one of the embodiments of the invention, the rack may be constructed of a metal frame having plates securable to a horizontal or vertical surface by means of adhesive by applying a double sided adhesive tape to the plates. In this embodiment of the invention, a roll of merchandise bags is at least partially cradled within a rectangular frame having a pair of parallel guide bars spaced from each other and disposed above and parallel to one side of the frame, between which parallel guide bars the merchandise bags may be drawn as they are unrolled from the roll in the cradle.

The merchandise bags may be of any type which are detachably joined along their ends to adjacent bags. Such bags could be of the T-shirt type or other type of merchandise bags, the open transverse edge of one bag of which is joined to the closed transverse edge of an adjacent bag and where the line of joinder defines either a T-shirt gap or chisel type central opening or merely an otherwise rupturable central area.

While the invention is particularly applicable to the T-shirt style bags and other styles of merchandise bags, it could equally be applied to rolls of rectangular sheets which are similarly joined together and have either an open or rupturable central area along the line of joinder of adjacent sheets.

It is a further feature of the present invention to provide a pair of snagging elements centrally disposed on one of the two parallel spaced-apart side members through which the bags or sheets are drawn. Preferably, a pair of snagging elements are fixedly secured to one of said members to project outwardly initially in a first section extending in the direction of travel of the bags as they are pulled between the two parallel side elements, with a second section angled transversely to such first section and with the ends of the second section being rounded. Snagging elements so constructed and disposed will allow the panel portions of each bag or sheet to be pulled below the rounded ends of the second sections of the snagging elements, but when the open or rupturable transverse line of joinder reaches such rounded ends, the latter penetrate the open or rupturable area and thereby restrain further movement of the next ensuing bag. Further pulling of the first bag in the initial direction of travel against the restraint applied by the snagging elements to the leading edge of the ensuing bag results in the detachment of the first bag from the second bag. However, when it is desired to withdraw the second and each ensuing bag through the spaced apart parallel elements, it is only necessary initially to pull such bag slightly in the second direction to clear the rounded edges of the snagging elements and then pull the panel portions of the bag or sheet across the rounded ends of snagging elements in the first direction until the next transverse line of joinder is intercepted by the pair of snagging elements, whereupon the separation is repeated as for each succeeding bag or sheet. Providing pairs of snagging elements has been found to prevent misthreading of bags through the guide bars and snagging device and to allow sales clerks to easily grab the lead bag with two fingers between the double snagging elements to facilitate the straight pulling of the bags. In addition, double snagging devices make it possible for the system to work most of the time even if bags are pulled out sideways at an extreme angle.

In a further embodiment of the invention, the roll holding cradle may be in the form of a rectangular tray made of a strong and rigid plastic, the ends of which rectangular tray may be vertically orificed to support at least one rectilinear side bar which serves either with a parallel spaced apart second bar to receive and pass between them the bags or sheets as they are unrolled and to carry the pair of snagging elements. One or both of the rectilinear elements could be part of the rectangular or U-shaped frame supported by posts extending upwardly from the end walls of the tray.

Alternatively, the bags or sheets could be passed between an upper side edge of the rectangular tray and a rectilinear bar supported at its ends parallel to, and spaced slightly apart from, said upper tray edge with either said edge or the parallel bar carrying the pair of snagging elements.

The rectilinear elements may be supported by vertical posts disposed in the ends of the tray to project vertically upwardly for attachment to the rectilinear side element or elements, or rectangular frame.

In another embodiment of the invention, the side supports of the frame may be upwardly extended and capped by a transverse plate member connecting the tops of the side supports and to which the transverse plate member may be welded or otherwise secured. This member may comprise an orificed plate with an edge clip adapted for mounting on a counter edge or shelf edge to support the member and its depending rack below a counter or shelf. Desirably, the upper surface of the mounting member may be provided with a double sided adhesive sheet for mounting; but to better ensure the mounted rack against dislodgement through the frequent intermittent lateral pulling of bags from the rack, the plate member should also be secured to the underside and edge of the shelf or counter by screws. The edge clip desirably may also be orificed to be screwed into the counter or shelf edge. Thereby, the entire rack may be most securely mounted to the underside of a counter or shelf.

DESCRIPTION OF THE DRAWINGS

In the accompanying drawings.

DESCRIPTION OF THE PREFERRED EMBODIMENT

Figure 4A:
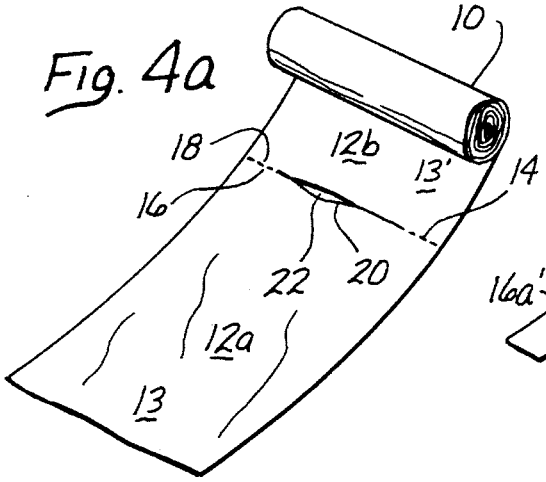
FIG. 4*a* is a perspective view of a chisel-cut roll of merchandise bags of the type to be dispensed from the rack of the present invention.
Figure 4B:
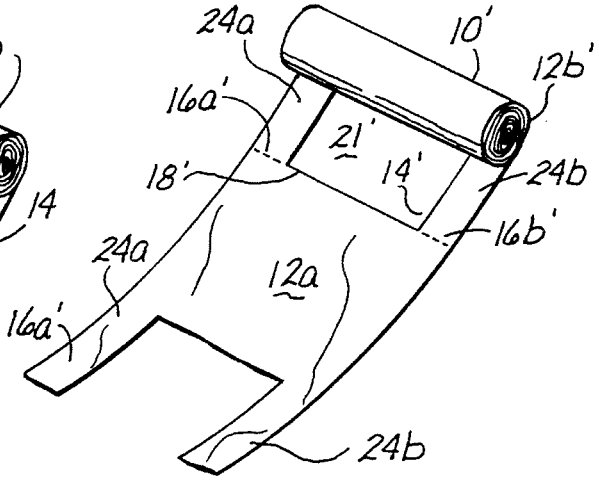
FIG. 4*b* is a perspective view similar to that of FIG. 4*a*, but showing a roll of T-shirt type merchandise bags.

Referring to the accompanying drawings, FIG. 4*a* illustrates a roll 10 of common chisel-cut merchandise bags 12*a*, 12*b* which are joined together along a transverse line 14. In this joinder, the trailing edge 16 of the bag 12*a* is joined to the leading edge 18 of the bag 12*b*. The line of joinder 14 may be by perforations across the full line with the central extent either especially weakened or rupturable, or the central area 20 may actually be made the subject of a chisel cut so that the adjoining bag edges 16 and 18 define an opening 22 shown in dotted lines on FIG. 4*a*. In the embodiment of FIG. 4*b*, the roll 10' is of a series of T-shirt bags 12*a*' etc. In this embodiment, the line of joinder 14' is actually bifurcated since only the lower edges 16*a*' and 16*b*' of the straps 24*a*, 24*b* of the bag 12*b*' are joined to the trailing edge 18' of the leading bag 12*a*'. In this embodiment, illustrated in FIG. 4*b*, an open central area 21' is defined by the trailing edge 18' of the bag 12*a*' and the leading edges 16*a*' and 16*b*' of the bag 12*b*'.

While it is contemplated that the rack of the present invention has particular application to merchandise bags and T-shirt style merchandise bags, it could also be utilized for rolls of plain sheets instead of merchandise bags, where the sheets are joined in a similar manner to the joinder of the bags shown particularly in FIG. 4*a*. In this specification and the appended claims, when the term "bags" or "rectangular bags" is used, it should be understood to comprehend not only single sheets of plastic, or other materials which are provided in roll form, but also plastic bags, such as merchandise bags and T-shirt bags, which are fabricated in series joined end-to-end with adjacent bags, and are provided in rolls. The term could also comprehend what is termed "plastic tubing".

Figure 1:
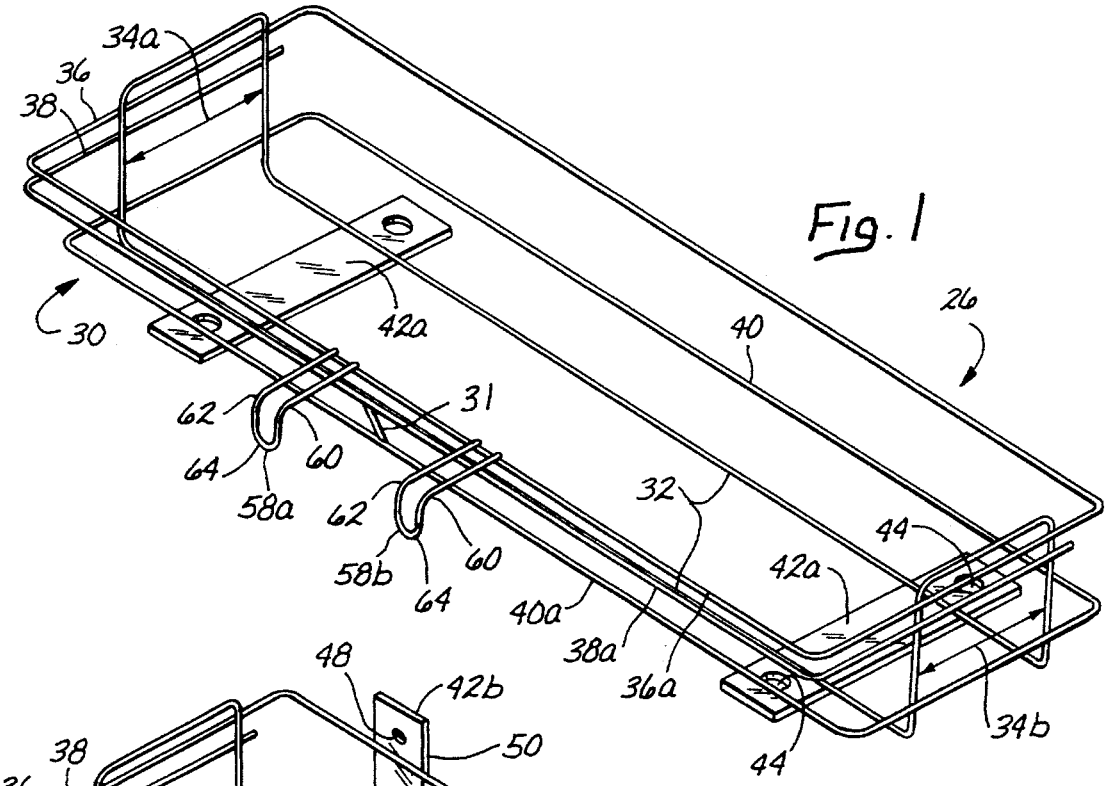
FIG. 1 is a perspective view of a frame-type rack for mounting on a counter or on a shelf.
Figure 1A:
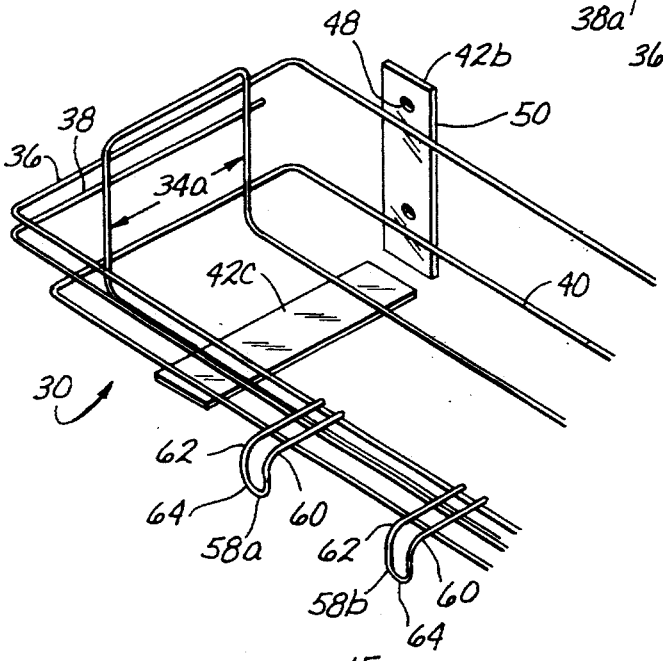
FIG. 1*a* is a partial perspective view of the rack of FIG. 1, but adapted for mounting on a vertical surface, such as a wall.

To provide for the easy dispensing of bags or sheets from rolls of the type shown in FIGS. 4*a* and 4*b*, it is a feature of the present invention to provide a rack 26, such as illustrated in FIGS. 1 and 1A of the drawings. Alternate forms of a suitable rack are illustrated in FIGS. 2, 2*a*, 3, 5, 6, 7 and 8 of the drawings.

Figure 3:
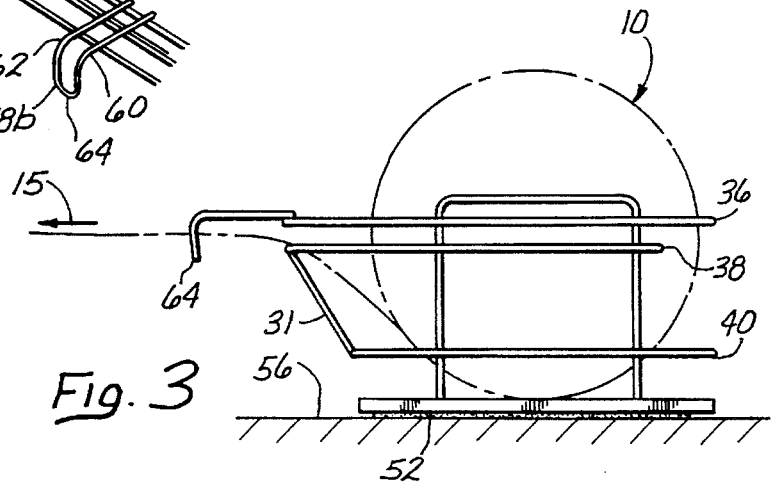
FIG. 3 is an end view of the rack shown in FIG. 1 with a roll of bags shown in phantom.

The rack as shown in FIG. 1 comprises a rectangular frame 28, in the form of a rectangular cradle 30, comprised of a rectangular frame base 32 bent upwardly at both ends 34*a* and 34*b* to which upwardly extending portions 34*a* and 34*b* are secured a transverse upper rectangular frame 36 and a parallel rectilinear U-shaped member 38, as well as a rectangular perimeter support 40. There may be secured to and below the frame base 32 a pair of mounting plates 42*a*; or, as shown in FIG. 1A, behind and to the rectangular members 36 and 40, a pair of vertical mounting plates 42*b*. However, when vertical plates 42*b* are provided for wall mounting, it is desirable to provide horizontal feet 42C at their lower ends to extend below the cradle 30 to prevent the bag roll from falling between bars forming the frame base 32. These plates 42*a*, 42*b* may be orificed at 44 on the horizontal plates 42*a*, or at 48 on the vertical plates 42*b*. In addition to the holes 44 and 48 in the plates 42*a*, 42*b* respectively, it may also be desirable to provide below the horizontal plate 42*a*, as shown in FIG. 3, or on the outside 50 of the vertical plate 42*b*, a double sided adhesive tape 52. Thereby the cradle 30 may be mounted either on a horizontal surface, such as a counter top 56 or against a wall (not shown) by screws passed through the holes 44, 48 or by one of tapes 52, depending upon whether the mounting is to be upon a horizontal surface 56 or against a wall (not shown).

It is also a feature of the present invention to provide a pair of snagging elements 58*a* and 58*b*, secured to extend horizontally outwardly from the upper rectangular frame member 36. Each of these snagging elements 58*a* and 58*b* comprises a horizontal section 60 and a downwardly bent section 62, which terminates in a rounded tip 64. The U-shaped member 38, previously referred to, is spaced sufficiently below the upper rectangular frame member 36 to allow sheets 12*a*, 12*b*, etc. to be drawn between the U-shaped member 38 and the upper rectangular member 36 and initially horizontally under the rounded tips 64 of the snagging elements 58*a* and 58*b*. To prevent the user from drawing any sheets 12*a*, 12*b*, etc., between the front bar 38*a* of the U-shaped member 38 and the front side 40*a* of the perimeter support 40, a vertical bar 31 is secured to front bar 38*a* and said front side 40*a* between the snagging elements 58*a*, 58*b*.

In use, then, the cradle 30 is mounted either to a horizontal surface 56, as shown in FIG. 3, or to a wall (not shown) by screws (also not shown) passed through holes 44 or 48 in the mounting plates 42*a*, 42*b* or by one of the tapes 52 or by both screws and the tapes. A roll 10 is then deposited in the cradle, preferably in the manner shown in FIG. 3, and the leading end of the first bag is passed between the side 38*a* of the U-shaped member 38 and the side 36a of the upper rectangular frame member 36 and under the rounded extremity 64 of the snagging elements 58*a* and 58*b*. The panel portion 13 of the bag or sheet 12*a* will ride under the rounded extremities 64 of the snagging elements 58*a*, 58*b* until the open central portion area 21 or 22 reaches the vertical sections 62 whereupon these latter sections penetrate the open area 21 or weakened central area 22 to restrain further movement in the direction of the arrow 15 of both the bag or sheet 12*a* and the bag or sheet 12*b*. Further pulling in the direction of the arrow of the bag or sheet 12*a* results in tearing bag 12*a* from the bag 12*b* along the transverse line 14, so that the sheet or bag 12*a* may be utilized for its intended purpose.

The ensuing sheet 12*b* may be removed by initially drawing it downwardly in the direction of the arrow 15 until its panel portion 13' may be pulled under the rounded termini 64 of the snagging elements 58*a* and 58*b* in the same manner that the panel portion 13 of sheet 12*a* was previously drawn under the rounded termini 64 of the snagging elements 58*a* and 58*b*.

The principles of the rack construction illustrated in FIGS. 1 and 3 and described above may be applied to a number of variations in the rack construction. Thus, in FIG. 5, the cradle 30 of FIG. 1 is largely replaced by a rectangular tray 70, the ends 72*a* and 72*b* of which may be formed with vertical receptacles 74*a* and 74*b* and 74*c* and 74*d*, respectively. These receptacles are adapted to receive posts 76*a*, 76*b*, 76*c*, and 76*d*, respectively, which extend downwardly from, and are secured to the upper rectangular frame member 36' and the U-shaped member 38' corresponding to 36 and 38, respectively, of the embodiment shown in FIG. 1. Snagging elements 58*a*' and 58*b*' correspond to the snagging elements 58*a* and 58*b* in the embodiment of FIG. 1.

It may readily be appreciated that when the posts 76*a*, 76*b*, 76*c* and 76*d* are pressed down respectively into the receptacles 74*a*, 74*b*, 74*c* and 74*d*, the rack will cradle a roll 10 (not shown in FIG. 5) and allow sheets or bags to be withdrawn between the sides 36*a*' and 38*a*' past the snagging elements 58*a*' and 58*b*' in the same manner as with the FIG. 1 embodiment. Plates (not shown) similar to plates 42*a* or 42*b* may be attached to the tray 70 to enable the tray 70 to be secured either to a horizontal surface (not shown) or to a vertical wall surface (also not shown).

Figure 5:
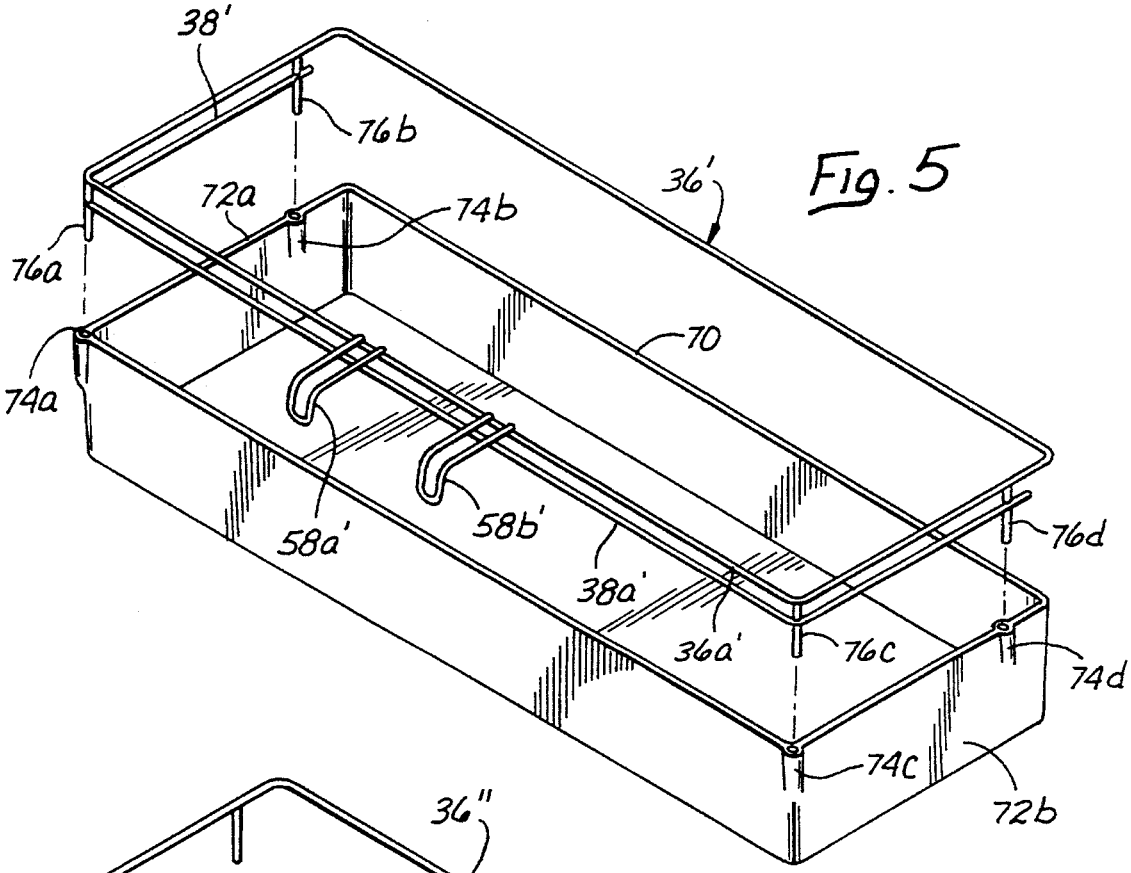
FIG. 5 is a perspective view of a modified version of the rack shown in FIG. 1.
Figure 6:
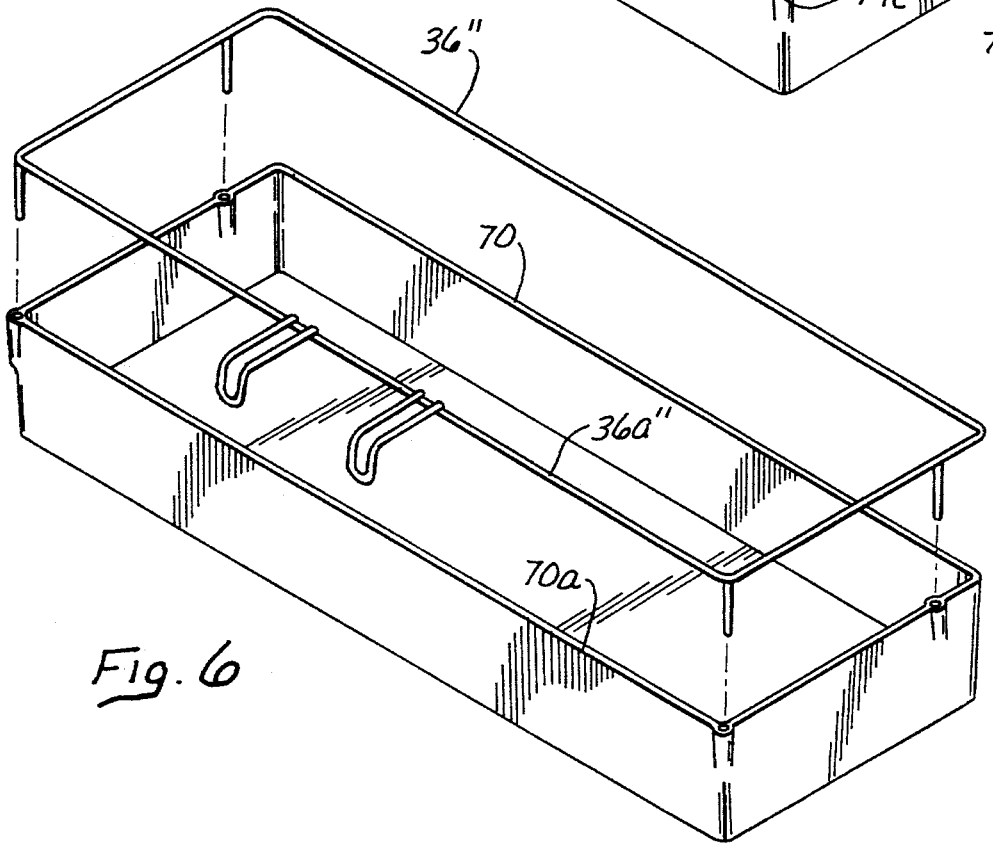
FIG. 6 is a perspective view similar to FIG. 5, showing a modification of the upper frame portion.

The embodiment illustrated in FIG. 6 is quite similar to that shown in FIG. 5. However, it may be seen that the U-shaped member 38' has also been eliminated. The sheets or bags then will be drawn between the upper edge 70*a* of the tray 70 and the side 36a" of the rectangular frame 36". Otherwise, the rack of FIG. 6 will operate in the same manner as that of FIG. 5.

Figure 7:
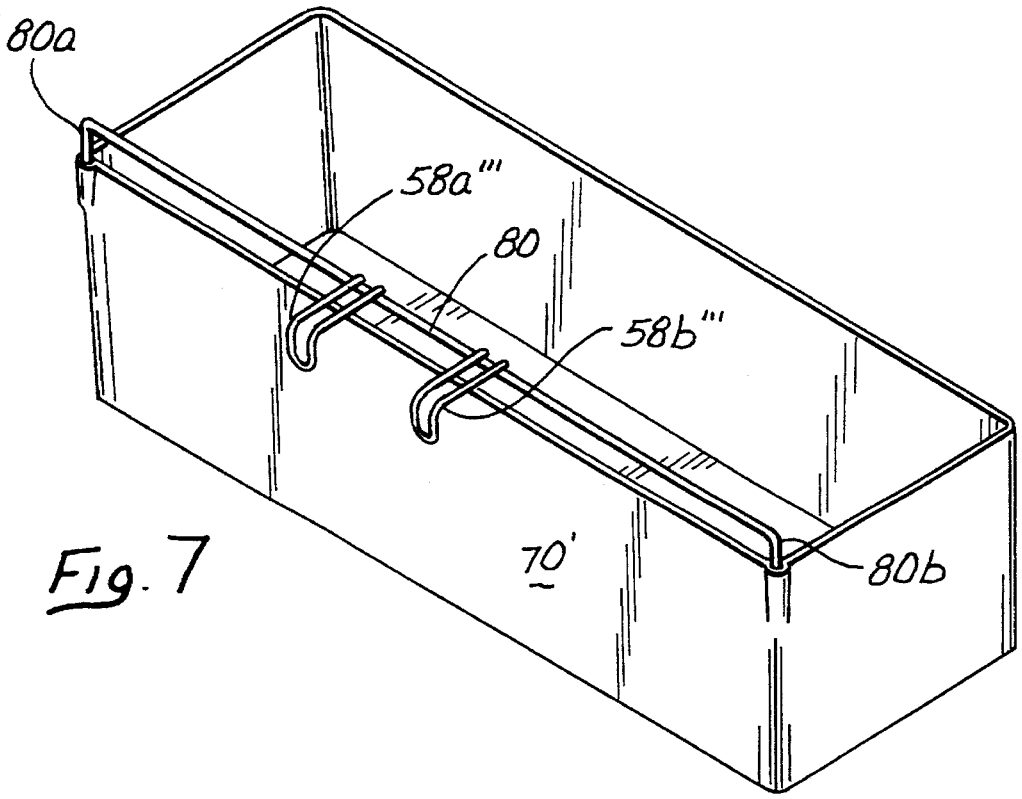
FIG. 7 is a perspective view of a further embodiment of the invention.

In the embodiment of FIG. 7, the upper rectangular frame member 36 of FIG. 1 has been completely eliminated as also has the U-shaped member 38. In lieu of these two members, a U-shaped strut 80, supported at its ends 80*a* and 80*b* and carrying a pair of snagging elements 58*a*" and 58*b*" is unitarily injection molded with the tray 70'. Again, it may be seen that the embodiment of FIG. 7 will operate in the same manner as the embodiments of FIGS. 1, 5 and 6.

Figure 8:
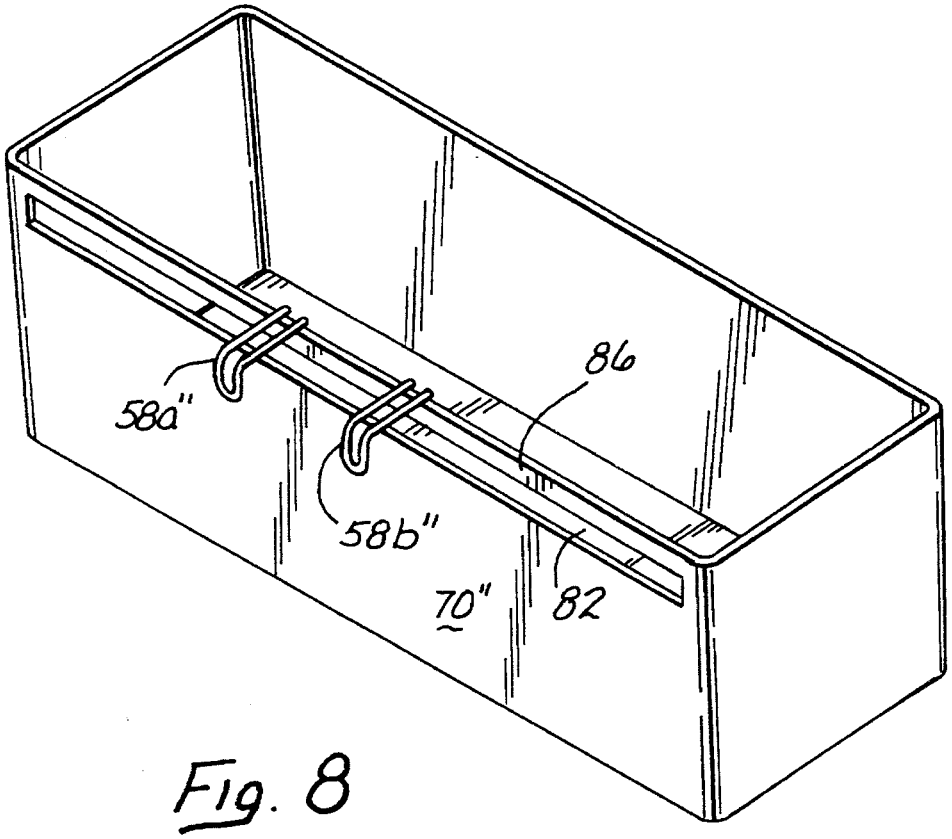
FIG. 8 is a perspective view of a still further embodiment of the invention.

In the embodiment of FIG. 8, the tray 70" is provided with a slit 82 in its forward side wall 84. The upper portion 86 of the side wall 84 above the slit 82 may be provided with a pair of snagging elements 58*a*" and 58*b*". In this embodiment, the sheets or bags 12*a* and 12*b* (FIG. 4*a*) would be drawn through the slit 82 and past the snagging elements 58*a*" and 58*b*" in the same manner as in the embodiment of FIGS. 1, 5, 6 and 7 hereinabove described.

Figure 2:
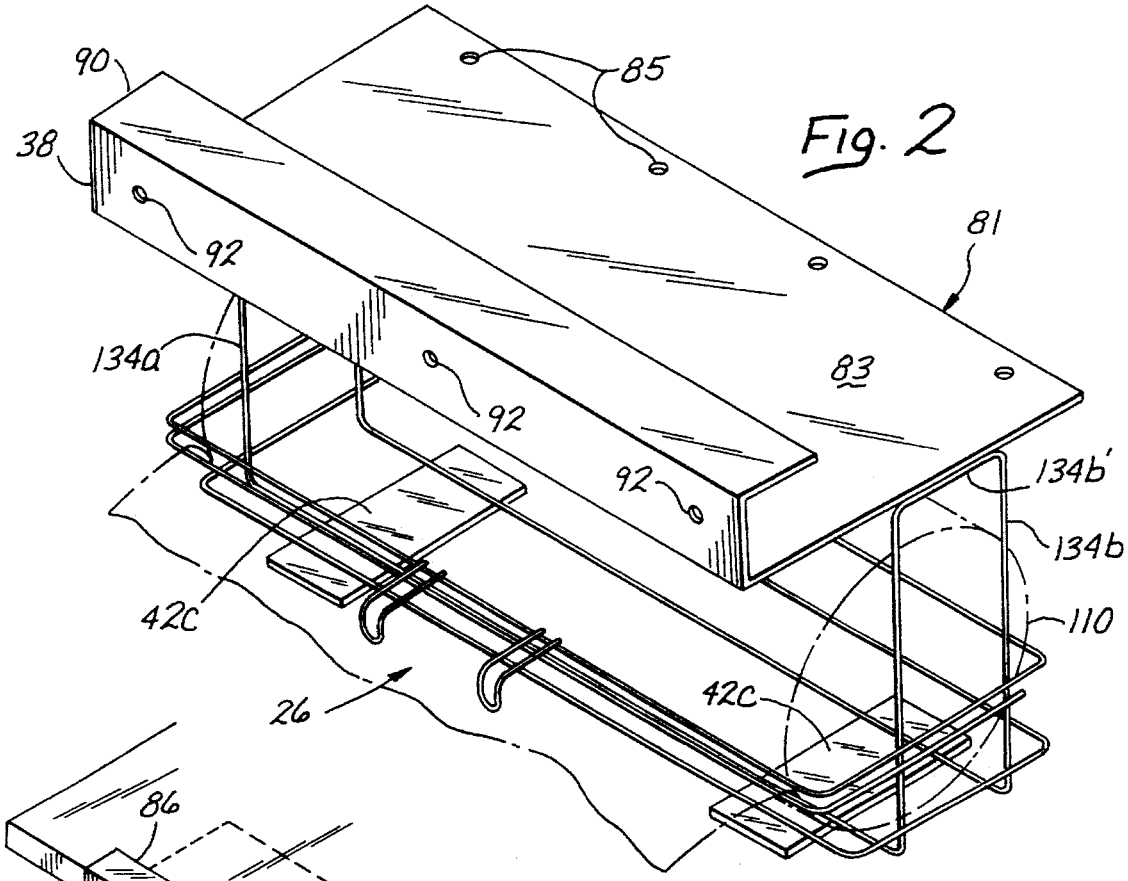
FIG. 2 is a perspective view of a modified rack for mounting under a counter or shelf.
Figure 2A:
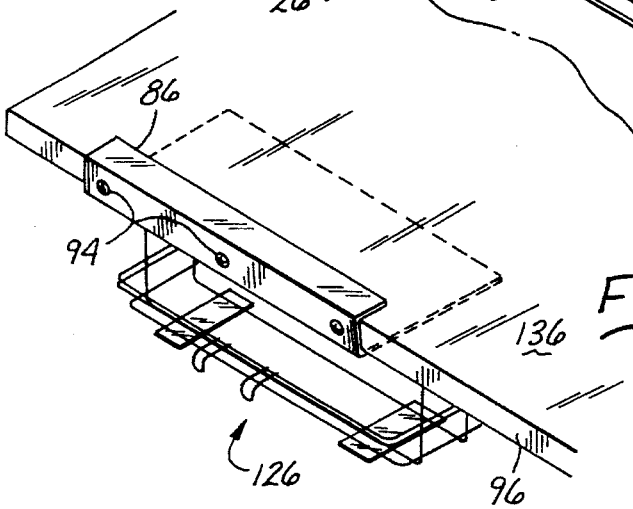
FIG. 2*a* is a miniaturized perspective view of a rack of FIG. 2 mounted on a counter edge.

In the further embodiment of the invention illustrated in FIG. 2, the rack of FIG. 1 is modified to greatly increase the extent to which the upwardly extending portions 34*a*, 34*b* protrude above the rectangular frame 36. Thus, it may be seen that portions formed as struts 134*a*, 134*b* extend upwardly by a distance well above the top of any roll 110 which may be placed in the cradle formed by the rack 126, and there is welded or otherwise secured to the upper transverse members 134*a*' (not shown), 134*b*' of the portions 134*a*, 134*b* respectively, a mounting member 81. The member 81 comprises a planar sheet 83 orificed at a plurality of locations 85, and an edge clip 87 comprising a vertical wall 88 and an inwardly extending transverse upper shelf 90. The wall 88 desirably may also be provided with a plurality of orifices 92 through which screws 94 (FIG. 2*a*) may be provided for mounting the member 81 and the depending rack 126 on the edge of, and under a counter or shelf 136. This FIG. 2 embodiment of the invention will be found to be particularly useful for situations in which it is desired to mount the dispensing cradle behind or under a counter or shelf 136 as shown in FIG. 2*a*. For this application, screws (not shown) may be inserted upwardly through the orifices 85 for screwing into the underside of the counter 136, while further screws 94 are passed through the orifices 92 and into the edge 96 of the counter 136. Thereby, the mounting member 81 and its depending rack 126 may be effectively secured to support a roll 110 for withdrawal of its bags in accordance with the method of the prior U.S. Pat. No. 5,209,371.

From the foregoing, it may be seen that the principles of the rack construction illustrated in the drawings and described with reference thereto, may be applied to create racks in a number of configurations to practice the method of the prior patent above referenced.

I claim:

1. A rack for separately dispensing rectangular bags from a roll of such bags, each bag being attached to adjacent bags along a rupturable transverse line by which each bag is separated from its ensuing bag on the roll upon the application of a predetermined quantum of force applied in a first direction to the first of the bags being unrolled when its next ensuing bag is restrained from movement in said first direction; said first direction being approximately radially, away from said roll; said rack comprising:

a rectangular cradle of such length and width dimensions as to accommodate the roll of bags and to permit the roll to be rotated in said cradle about an axis parallel to the sides of the cradle, said cradle having bottom support means lying in a first plane on which the roll of bags is placed and supported, and a rectangular perimeter support to retain the roll on the bottom support means, said perimeter support having a pair of ends connected together by a forward side element and a rear side element, said perimeter support being disposed at least partially in a second plane above and parallel to the first plane to encompass at least a portion of the roll of bags;

means to secure the rectangular cradle to a supporting planar surface;

said cradle further including a rectangular frame member disposed in a third plane above and spaced from the second plane, said rectangular frame member being supported parallel to the forward side element of said perimeter support;

said cradle further including a rectilinear member disposed adjacent and parallel to the rectangular frame member and spaced therefrom;

a pair of parallel snagging elements spaced apart from each other and attached to and disposed to extend laterally outwardly from the forward side of the rectangular frame member, each of said snagging elements including a first section disposed to extend outwardly from and normal to said rectangular frame member, and a second section disposed to extend from said first section in a direction angled transversely to the first section, for a predetermined distance, said second section terminating in a rounded end, whereby, when the first bag of the roll is passed between the forward side of the rectangular frame member and the rectilinear member, and is pulled therebetween in the first direction, the first bag and its next ensuing bag will unroll until the rupturable transverse lines separating the first bag from the ensuing bag reaches the rounded ends of the second sections of the snagging elements, whereupon said rounded ends puncture said rupturable line and restrain continued movement of the ensuing bag, so that further pulling of the first bag in the first direction results in detachment of the first bag from the ensuing bag along said rupturable transverse line; and further withdrawal of the ensuing bag is accomplished by grasping its edge between the snagging elements, pulling it initially in a second direction generally transverse to the first direction, and thereafter in the first direction.

2. The rack for dispensing bags as described in claim 1 wherein the supporting surface is a wall and the means to secure the cradle to said supporting surface comprise a pair of plates fixedly attached to the rear side of the rectangular perimeter support and attachable to the wall, each of said plates having an inwardly facing side and an outwardly facing side.

3. The rack for dispensing as described in claim 2 wherein the means to secure further includes an adhesive, adapted to stick to the wall, affixed to the outwardly facing sides of the plates.

4. The rack for dispensing as described in claim 2 wherein the means to secure further includes orifices through the plates to permit the plates to be secured to the wall by fasteners passed through said orifices and embedded in the wall.

5. The rack for dispensing as described in claim 1 wherein the supporting surface is a horizontal surface and the means to secure the cradle to said supporting surface comprise a pair of plates fixedly secured to the underside of the bottom support means and having means to secure said plates to said horizontal surface, each of said plates having an inwardly facing side and an outwardly facing side.

6. The rack for dispensing as described in claim 5 wherein the means to secure further includes an adhesive, adapted to stick to the horizontal surface, affixed to the outwardly facing sides of the plates.

7. The rack for dispensing as described in claim 5 wherein the means to secure further includes orifices through the plates to permit the plates to be secured to the horizontal surface by fasteners passed through the orifices and embedded in said surface.

8. The rack for dispensing as described in claim 1 wherein the bottom support means and the rectangular perimeter support are formed by a rectangular tray having a pair of end walls, connected at their respective ends by a forward side wall, and a rear side wall, said walls having rims, said walls comprising the rectangular perimeter support and having at least the rim of the forward wall disposed in the second plane.

9. The rack for dispensing as described in claim 8 wherein the rectangular frame member is supported at its ends by the ends of the tray.

10. The rack for dispensing as described in claim 1 wherein the rectangular cradle is a rectangular frame.

11. A rack for separately dispensing rectangular bags from a roll of bags, each bag being attached to adjacent bags along a rupturable transverse line by which each bag is separated from its ensuing bag on the roll upon the application of a predetermined quantum of force applied in a first direction to the first of the bags being unrolled when its next ensuing bag is restrained from movement in said first direction; said first direction being approximately radially, away from said roll; said rack comprising:

a rectangular cradle of such length and width dimensions as to accommodate the roll of bags and to permit the roll to be rotated in said cradle about said axis parallel to the sides of the cradle, said cradle having bottom support means lying in a first plane on which the roll of sheets is placed and supported, and a rectangular perimeter support to retain the roll on the bottom support means, said perimeter support being disposed at least partially in a second plane above and parallel to the first plane to encompass at least a portion of the roll of bags and having a forward side element;

means to secure the rectangular cradle to a supporting surface;

said cradle further including a first rectilinear element disposed in a third plane above and spaced from the second plane, said first rectilinear element being supported parallel to the forward side element of said perimeter support;

said cradle further including a second rectilinear element supportedly disposed adjacent and parallel to the first rectilinear element but spaced therefrom;

a pair of parallel snagging members spaced apart from each other and attached to and disposed to extend laterally outwardly from the forward side of one of said first and second rectilinear elements, each of said snagging elements including a first section disposed to extend outwardly from and normal to the one of said rectilinear elements from which it extends, and a second section disposed to extend from the first section in a direction angled transversely to the first section, for a predetermined distance, said second section terminating in a rounded end, whereby, when the first bag of the roll is passed through the space between the first and second rectilinear elements, and is pulled therethrough in the first direction, the first bag and the next ensuing bag will unroll until the rupturable transverse line separating the first bag from the ensuing bag reaches the rounded ends of the second sections of the snagging elements; whereupon said rounded ends puncture said rupturable line and restrain continued movement of the ensuing bag, so that further pulling of the bag in the first direction results in detachment of the first bag from the ensuing bag along said rupturable transverse line; and further withdrawal of the ensuing bag is accomplished by grasping its edge between the snagging elements, pulling it initially in a second direction generally transverse to the first direction, and thereafter in the first direction.

12. The rack for dispensing as described in claim 11 wherein a vertical element is provided to extend between forward sides of the perimeter support and one of said first and second rectilinear elements which is closer to the perimeter support, said vertical element being disposed between said pair of snagging elements, thereby to prevent the bags from being withdrawn between said perimeter support and the closer of said first and second rectilinear elements.

13. A rack for separately dispensing rectangular bags from a roll of such bags, said roll having a diameter, each bag being attached to adjacent bags along a rupturable transverse line by which each bag is separated from its ensuing bag on the roll upon the application of a predetermined quantum of force applied in a first direction to the first of the bags being unrolled when its next ensuing bag is restrained from movement in said first direction; said first direction being approximately radially, away from said roll; said rack comprising:

a rectangular cradle of such length and width dimensions as to accommodate the roll of bags and to permit the roll to be rotated in said cradle about an axis parallel to the sides of the cradle, said cradle having bottom support means lying in a first plane on which the roll of bags is placed and supported and a rectangular perimeter support to retain the roll on the bottom support means, said perimeter support having a pair of ends connected together by a forward side element and a rear side element, said perimeter support being disposed at least partially in a second plane above and parallel to the first plane and in alignment with the bottom support means to encompass at least a part of the roll of bags;

means to secure the rectangular cradle below a horizontal shelf, said shelf having a frontal edge, said means comprising strut means extending upwardly from, and secured to, each of said pair of ends of the perimeter support such that upper extremities of said strut means are spaced from said bottom support means by a distance in excess of the diameter of the roll to be supported on the bottom support means;

said means to secure the rectangular cradle further including transverse mounting means secured to the upper extremities of said strut means, said transverse mounting means comprising a horizontal plate having an upper side and disposed in a third plane parallel to the first plane, and means to secure said plate to the underside of said shelf, said plate having a forward edge and clip means extending upwardly from said forward edge, said clip means comprising a vertical wall portion extending upwardly a distance at least as great as a thickness of the frontal edge of said shelf and having an upper edge, and a further portion extending rearwardly from the upper edge parallel to the third plane, whereby said rectangular cradle is mounted on the frontal edge of said shelf by said clip means;

said cradle further including a rectangular frame member disposed in a fourth plane above and spaced from the second plane but below said third plane, said rectangular frame member being supported parallel to the forward side element of said perimeter support;

said cradle further including a rectilinear member disposed adjacent and parallel to the rectangular frame member and spaced therefrom;

a pair of parallel snagging elements spaced apart from each other and attached to and disposed to extend laterally outwardly from the forward side of the rectangular frame member, each of said snagging elements including a first section disposed to extend outwardly from and normal to said rectangular frame member, and a second section disposed to extend from said first section in a direction angled transversely to the first section, for a predetermined distance, said second section terminating in a rounded end, whereby, when the first bag of the roll is passed between the forward side of the rectangular frame member and the rectilinear member, and is pulled therebetween in the first direction, the first bag and its next ensuing bag will unroll until the rupturable transverse line separating the first bag from the ensuing bag reaches the rounded ends of the second sections of the snagging elements, whereupon said rounded ends puncture said rupturable line and restrain continued movement of the ensuing bag, so that further pulling of the first bag in the first direction results in detachment of the first bag from the ensuing bag along said rupturable transverse line; and further withdrawal of the ensuing bag is accomplished by grasping its edge between the snagging elements, pulling it initially in a second direction generally transverse to the first direction, and thereafter in the first direction.

14. The rack for dispensing as described in claim 13 wherein the clip means further includes orifices through the vertical wall portion to permit said clip means to be screwed into the frontal edge of the shelf.

15. The rack for dispensing as described in claim 13 wherein the transverse mounting means further includes orifices through said plate to permit said plate to be screwed to the underside of the shelf.

16. A rack for separately dispensing rectangular bags from a roll of such bags, each bag being attached to adjacent bags along a rupturable transverse line by which each bag is separated from its ensuing bag on the roll upon the application of a predetermined quantum of force applied in a first direction to the first of the bags being unrolled when its next ensuing bag is restrained from movement in said first direction; said first direction being radially, away from said roll; said rack comprising:

a rectangular cradle of such length and width dimensions as to accommodate the roll of bags and to permit the roll to be rotated in said cradle about an axis parallel to the sides of the cradle, said cradle having bottom support means lying in a first plane on which the roll of bags is placed and supported, and a rectangular perimeter support to retain the roll on the bottom support means, said perimeter support having a pair of ends connected together by a forward side element and a rear side element, said perimeter support being disposed at least partially in a second plane above and parallel to the first plane to encompass at least a portion of the roll of bags; means to secure the rectangular cradle to a supporting planar surface;

said cradle further including a rectilinear member disposed in a third plane above and spaced from the second plane, said rectilinear element being supported parallel to the forward side element of said perimeter support;

a pair of parallel snagging elements spaced apart from each other and attached to and disposed to extend laterally outwardly from the forward side of the rectilinear element, each of said snagging elements including a first section disposed to extend outwardly from and normal to said rectilinear element, and a second section disposed to extend from said first section in a direction angled transversely to the first section to extend at least partially across the spacing between the second and third planes for a predetermined distance, said second section terminating in a rounded end, whereby, when the first bag of the roll is passed between the forward sides of the rectangular perimeter support and the rectilinear element spaced therefrom, and is pulled therebetween in the first direction, the first bag and its next ensuing bag will unroll and pass over the rounded ends of the second section of the snagging elements until the rupturable transverse line separating the first bag from the ensuing bag reaches said rounded ends of the second sections of the snagging elements, whereupon said rounded ends will puncture said rupturable line and restrain continued movement of the ensuing bag, so that further pulling of the first bag in the first direction results in detachment of the first bag from the ensuing bag along said rupturable transverse line; and further withdrawal of the ensuing bag is accomplished by grasping its edge between the snagging elements, pulling it initially over said rounded ends of the snagging elements, and thereafter further pulling it in the first direction.

* * * * *